US011866903B2

(12) United States Patent
Lin et al.

(10) Patent No.: US 11,866,903 B2
(45) Date of Patent: Jan. 9, 2024

(54) ELECTRICALLY-DRIVEN VIBRATORY HAMMER

(71) Applicant: Zhejiang Yongan Construction Machinery Co., Ltd., Wenzhou (CN)

(72) Inventors: Deng Lin, Wenzhou (CN); Yuanwan Chen, Wenzhou (CN); Jian Zhang, Wenzhou (CN); Zhenyu Yang, Wenzhou (CN); Zengzeng Chen, Wenzhou (CN); Yachun Zhang, Wenzhou (CN); Min Jia, Wenzhou (CN)

(73) Assignee: Zhejiang Yongan Construction Machinery Co., Ltd., Wenzhou (CN)

( * ) Notice: Subject to any disclaimer, the term of this patent is extended or adjusted under 35 U.S.C. 154(b) by 5 days.

(21) Appl. No.: 17/842,976

(22) Filed: Jun. 17, 2022

(65) Prior Publication Data

US 2023/0002996 A1 Jan. 5, 2023

(30) Foreign Application Priority Data

Jun. 30, 2021 (CN) ..... 202110739078.5

(51) Int. Cl.
*E02D 7/18* (2006.01)

(52) U.S. Cl.
CPC ..... *E02D 7/18* (2013.01)

(58) Field of Classification Search
CPC ..... B23D 35/002; B23D 15/12; E02D 7/18
See application file for complete search history.

(56) References Cited

U.S. PATENT DOCUMENTS

| | | | | |
|---|---|---|---|---|
| 5,355,964 | A * | 10/1994 | White | E02D 7/18 173/1 |
| 7,168,890 | B1 * | 1/2007 | Evarts | E02D 7/18 405/232 |
| 9,249,551 | B1 * | 2/2016 | White | E02D 11/00 |
| 2009/0200055 | A1 * | 8/2009 | White | E02D 7/18 173/49 |

* cited by examiner

*Primary Examiner* — Nathaniel C Chukwurah
(74) *Attorney, Agent, or Firm* — Harter Secrest & Emery LLP; Michael Nicholas Vranjes

(57) ABSTRACT

An electrically-driven vibratory hammer is provided, which has a power supply, is wirelessly controlled, can increase the vibration amplitude and can detect the data of the vibratory hammer in real time. Through the arrangement of storage batteries, workers can also directly work through the built-in storage batteries during construction in some remote areas, without laying additional lines, and the cost is reduced. Furthermore, a movable toothed plate previously driven by a hydraulic cylinder is changed into a clamping electric cylinder capable of directly working through the storage batteries, so that a pile body can be directly clamped without an external hydraulic pump station during working. Through the improvement, the workers can directly work without additionally laying basic equipment during construction in construction sites with incomplete facilities, the construction period is shortened, the construction cost is saved, intelligent control is achieved.

19 Claims, 5 Drawing Sheets

ELECTRICALLY-DRIVEN VIBRATORY HAMMER

CROSS REFERENCE TO RELATED APPLICATION

This patent application claims the benefit and priority of Chinese Patent Application No. 202110739078.5, filed on Jun. 30, 2021, the disclosure of which is incorporated by reference herein in its entirety as part of the present application.

TECHNICAL FIELD

The present disclosure relates to the engineering machinery of construction foundations, in particular to an electrically-driven vibratory hammer.

BACKGROUND ART

The vibratory hammer is a construction foundation engineering device which generates strong exciting force to drive an object into the ground after being electrified. According to the working principle, the paired eccentric wheels are driven to rotate oppositely by using the motor, transverse centrifugal forces generated by the eccentric wheels are counteracted, so that the vertical centrifugal forces generated by the eccentric wheels cancelled each other out, and the vibration excitation box generates vertical up-down vibration through high-speed rotation of the eccentric wheels, so that the purpose of pile sinking is achieved. The vibratory hammer is mainly composed of a vibration damping device, a vibration device and a clamping device.

The existing vibratory hammer has the following defects in actual use.

Firstly, the existing clamping device is an assembly used for clamping a pile body for piling, the principle is that toothed plates are driven to clamp the pile body through a hydraulic cylinder, but the structure needs to be externally connected with a hydraulic pump station, the hydraulic cylinder is arranged outside a clamp body, the hydraulic cylinder is exposed outside, collision is prone to occur, the clamp is loosened, causing the steel pipe pile falls off.

Secondly, in the existing vibration device, the vibration excitation box mainly uses the motor to drive eccentric wheels to rotate at high speed through belt pulleys to realize vibration, but in the belt pulley transmission mode, the belt pulleys are exposed outside and easily and elastically slides and slips, so that the vibration device is unstable, and thus, the arrangement of the eccentric wheels is not compact enough, and the vibration excitation box has the problems of low vibration amplitude and non-concentration in torque.

Thirdly, the existing vibratory hammer cannot detect the sinking speed and the perpendicularity in real time, the bearing temperature of the vibratory hammer cannot be detected in real time, and constructors cannot remotely control the vibratory hammer to perform all kinds of work in real time through various data.

Fourthly, during construction in some remote areas, circuits are not laid on a construction site, so that the vibratory hammer can normally work only after circuits are laid before working, and if the work amount is not large, the circuits need to be laid in a time-consuming manner, so that the construction in the areas is very inconvenient, and the construction period is too long.

SUMMARY

Aiming at the defects in the prior art, the present disclosure provides an electrically-driven vibratory hammer which is provided with a power supply, is wirelessly controlled, can increase the vibration amplitude and can detect the data of the vibratory hammer in real time.

In order to achieve the purpose, the present disclosure provides the following technical solutions. An electrically-driven vibratory hammer comprises a vibratory hammer body, the vibratory hammer body is sequentially provided with a vibration damping device, a vibration device and a clamping device, the vibration device comprises a vibration excitation box, a top plate linked with the vibration excitation box, a plurality of eccentric wheels and vibration excitation motors linked with the eccentric wheels, the eccentric wheels each are arranged in the vibration excitation box and provided with a semicircular cross section, the vibration damping device comprises a vibration damping frame erected on the top plate, a plurality of pieces of vibration damping rubber evenly distributed on the vibration damping frame and a vibration absorption cover connected with the vibration damping frame, and the clamping device comprises an electrically-driven clamp arranged at an end, away from the vibration damping device, of the vibration excitation box, wherein the vibratory hammer body further comprises storage batteries, the vibration excitation motors are electrically connected with the storage batteries, one end of the electrically-driven clamp is connected with the vibration excitation box, another end of the electrically-driven clamp is provided with a movable toothed plate and a fixed toothed plate, one side of the electrically-driven clamp is provided with a clamping electric cylinder electrically connected with the storage batteries, and the clamping electric cylinder drives the movable toothed plate to move back and forth towards the fixed toothed plate through a telescopic driving structure, so that the movable toothed plate and the fixed toothed plate form a clamping jaw.

By adopting the technical solution, the number of the eccentric wheels is preferably an even number, and then horizontal force is counteracted. Through the arrangement of storage batteries, workers can directly work through the built-in storage batteries during construction in some remote areas, without laying additional lines, and the cost is reduced. Furthermore, a movable toothed plate previously driven by a hydraulic cylinder is changed into a clamping electric cylinder capable of directly working through the storage batteries, so that a pile body can be directly clamped without an external hydraulic pump station during working. Through the improvement, the workers can directly work without additionally laying basic equipment during construction in construction sites with incomplete facilities, the construction period is shortened, and the construction cost is saved.

The electrically-driven vibratory hammer can be further arranged such that, the telescopic driving structure comprises a motion cavity for the movable toothed plate arranged inside the electrically-driven clamp, a piston sleeve arranged in the motion cavity and fixedly connected with the movable toothed plate, a screw rod arranged in the piston sleeve, a driving gear arranged at an output end of the clamping electric cylinder, and a synchronous belt engaged with the driving gear, one end of the screw rod is in threaded connection with the piston sleeve, a driven gear meshed with the synchronous belt is arranged at another end of the screw rod, and the clamping electric cylinder drives the piston sleeve to move towards the fixed toothed plate along the motion cavity through the synchronous belt.

By adopting the technical solution, the clamping electric cylinder drives the screw rod to rotate through the synchronous belt, the screw rod drives the piston sleeve to move front and back, and then the movable toothed plate is driven to move back and forth towards the fixed toothed plate. The motion cavity is formed in the electrically-driven clamp, such that the piston sleeve is arranged in the electrically-driven clamp through the motion cavity, and the possibility of exposure collision is avoided, so that the clamping stability of the clamp is improved.

The electrically-driven vibratory hammer can be further arranged such that, protective shells for mounting the storage batteries are arranged at a side of the vibration damping device, the storage batteries are mounted in the protective shells, and mounting pressing strips are arranged above the protective shells.

By adopting the technical solution, through the arrangement of the protective shells, collision damage of the storage batteries is avoided; and through the arrangement of the mounting pressing strips, the batteries are convenient to disassemble and assemble and can be replaced at any time.

The electrically-driven vibratory hammer is further arranged such that, a dustproof cover for accommodating the synchronous belt is arranged at a side of the electrically-driven clamp, and the driving gear and the driven gear are both mounted in the dustproof cover.

By adopting the technical solution, through the arrangement of the dustproof cover, the possibility that exposed belt pulleys are polluted is avoided, and the clamping stability of the clamp is improved.

The electrically-driven vibratory hammer is further arranged such that, the vibratory hammer body further comprises wireless control devices, the wireless control devices comprise wireless receivers and a remote controller, the wireless receivers are electrically connected with the storage batteries, and the wireless receivers are in communication connection with the vibration excitation motors and the clamping electric cylinder.

By adopting the technical solution, through the arrangement of the wireless control devices, various data of the vibration excitation motors, the clamping electric cylinder and the storage batteries can be transmitted to the remote controller through the wireless receivers, so that constructors can detect and control the vibration excitation motors, the clamping electric cylinder and the storage batteries in time, such as the rotating speed and current of the motors and the supply and discharge or battery capacity of the storage batteries; and the intelligent operation is realized, so that the constructors can realize energy-saving and reasonable pile sinking.

The electrically-driven vibratory hammer can be further arranged such that, a vibration excitation gear meshed with an eccentric wheel is arranged at an output end of a vibration excitation motor, and the vibration excitation motor drives the vibration excitation gear to rotate through a spline shaft.

By adopting the technical solution, the spline shaft drives the vibration excitation gear to rotate, rotation oscillation of the eccentric wheel is achieved, the problem that rotating parts are exposed in previous belt pulley transmission is solved, the spline shaft transmission size is small, the structure is more compact, and the vibration amplitude of the vibratory hammer is increased.

The electrically-driven vibratory hammer can be further arranged such that, one side of each storage battery is provided with an external cable interface.

By adopting the technical solution, through the arrangement of the external cable interface, power is supplied to the storage batteries; and meanwhile, a construction site with a power supply condition is directly connected with an external power supply through the external cable interface to directly work.

The electrically-driven vibratory hammer can be further arranged such that, a perpendicularity sensor, a displacement sensor and a temperature sensor are mounted on the vibration excitation box, the perpendicularity sensor, the displacement sensor and the temperature sensor are all electrically connected with the storage batteries, and the perpendicularity sensor, the displacement sensor and the temperature sensor are in communication connection with the wireless receivers.

By adopting the technical solution, through the arrangement of the perpendicularity sensor, operators can adjust the perpendicularity and adjust the angle of the crane according to real-time data sent by the wireless receivers so as to meet the construction perpendicularity requirement, the real-time sinking speed of the vibratory hammer is detected through the displacement sensor, and then the rotating speed and current of the motor are controlled, so that the constructors can realize energy-saving and reasonable pile sinking; and the temperature of the bearing is detected in real time through the temperature sensor, so that the bearing is prevented from being overheated.

The electrically-driven vibratory hammer can be further arranged such that, a touch control screen is arranged on the remote controller.

By adopting the technical solution, through the arrangement of the touch control screen, data monitored by the perpendicularity sensor, the displacement sensor and the temperature sensor are displayed on the touch control screen, various data of the clamping electric cylinder, the vibration excitation motors and the storage batteries can be displayed and controlled through the touch control screen, and remote control is achieved.

The electrically-driven vibratory hammer can be further arranged such that, the vibration excitation motors are arranged at two ends of the vibration excitation box, mounting cavities for fixing the eccentric wheels are formed in the vibration excitation box, the number of the eccentric wheels is four, and the vibration excitation gears and the eccentric wheels are arranged in a line.

By adopting the technical solution, through the arrangement of the mounting cavities, the four eccentric wheels are mounted in the mounting cavities and do not shift or swing during rotation, so that the stability of the vibratory hammer is improved; and through the gear structures arranged in a line, the structure is more compact, the vibration amplitude of the vibratory hammer is increased.

The present disclosure is further described below in combination with the attached figures.

DETAILED DESCRIPTION OF THE EMBODIMENTS

Figure 1:
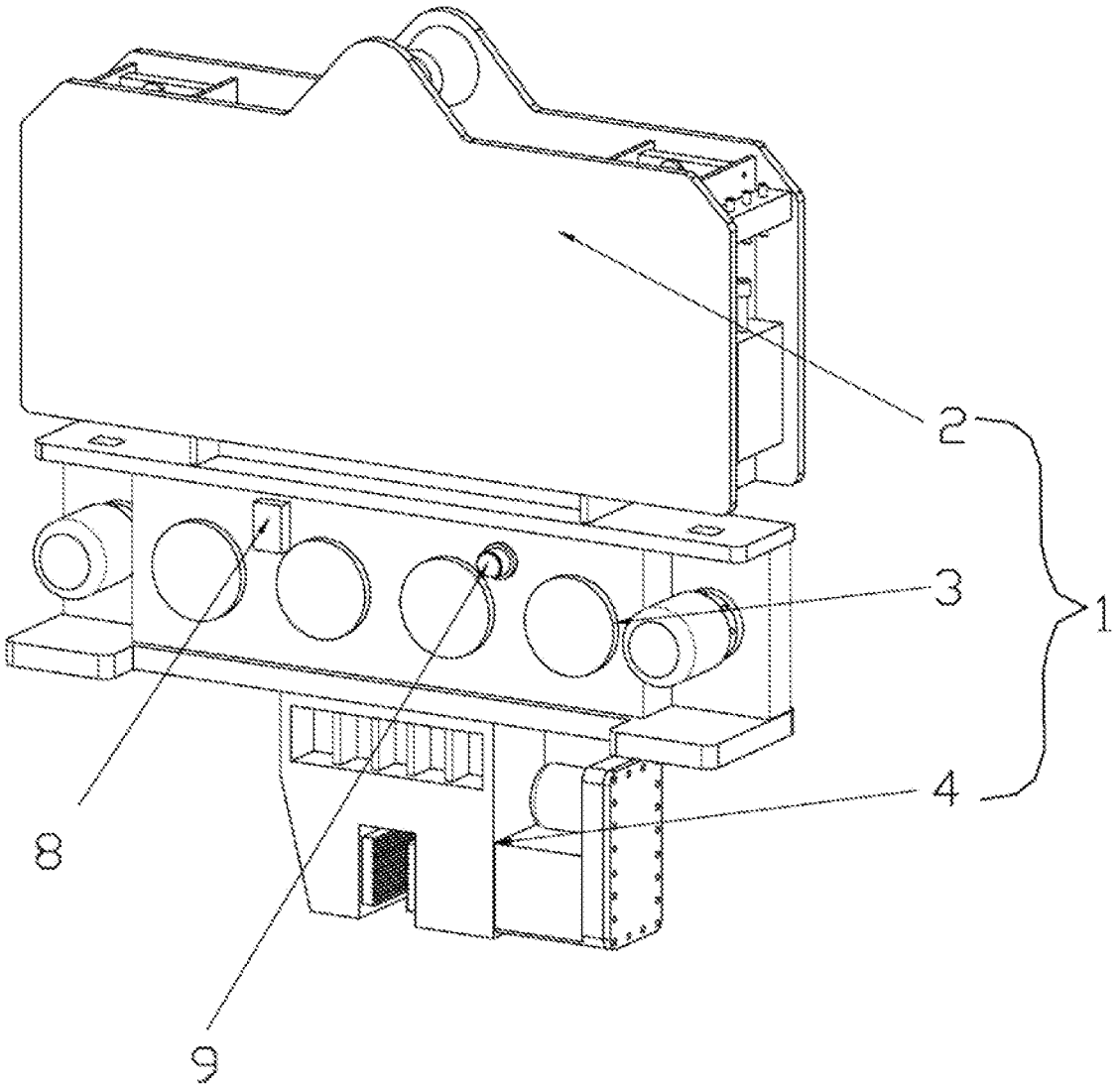
FIG. 1 is a stereoscopic schematic view of the embodiment in the present disclosure.
Figure 2:
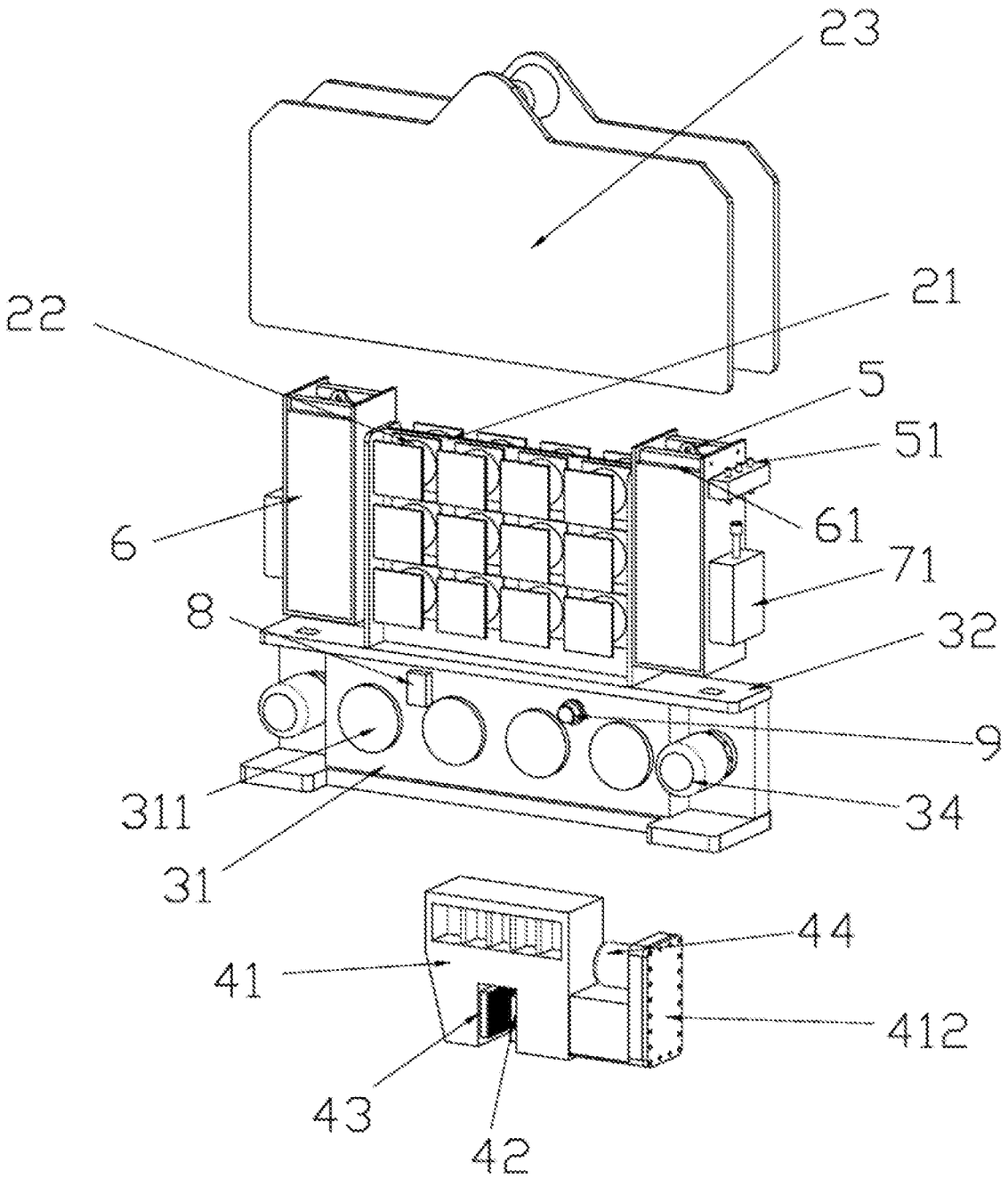
FIG. 2 is an explosive view of FIG. 1.
Figure 3:
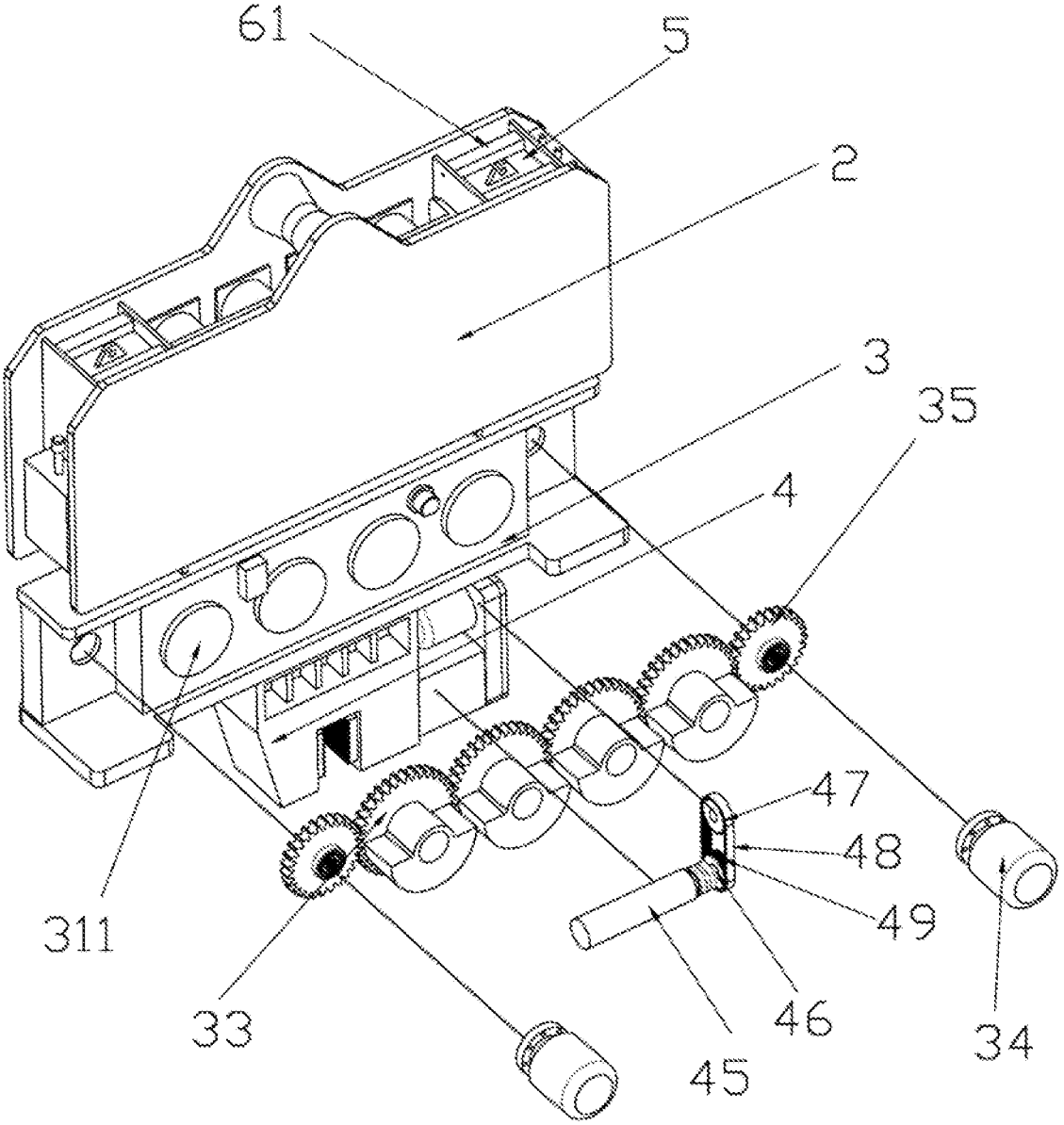
FIG. 3 is a structural schematic view of the embodiment in the present disclosure.
Figure 4:
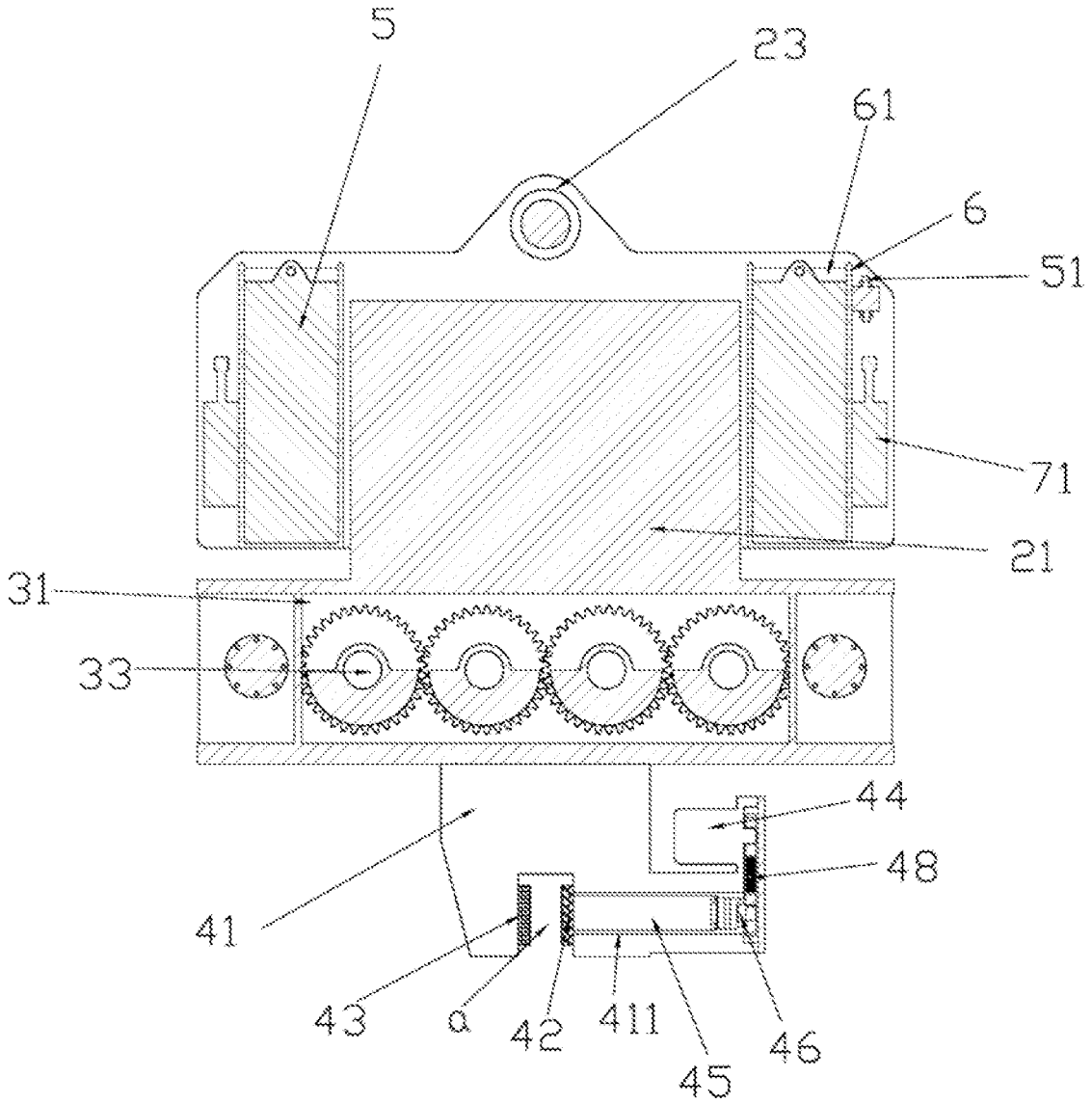
FIG. 4 is a section view of the embodiment in the present disclosure.
Figure 5:
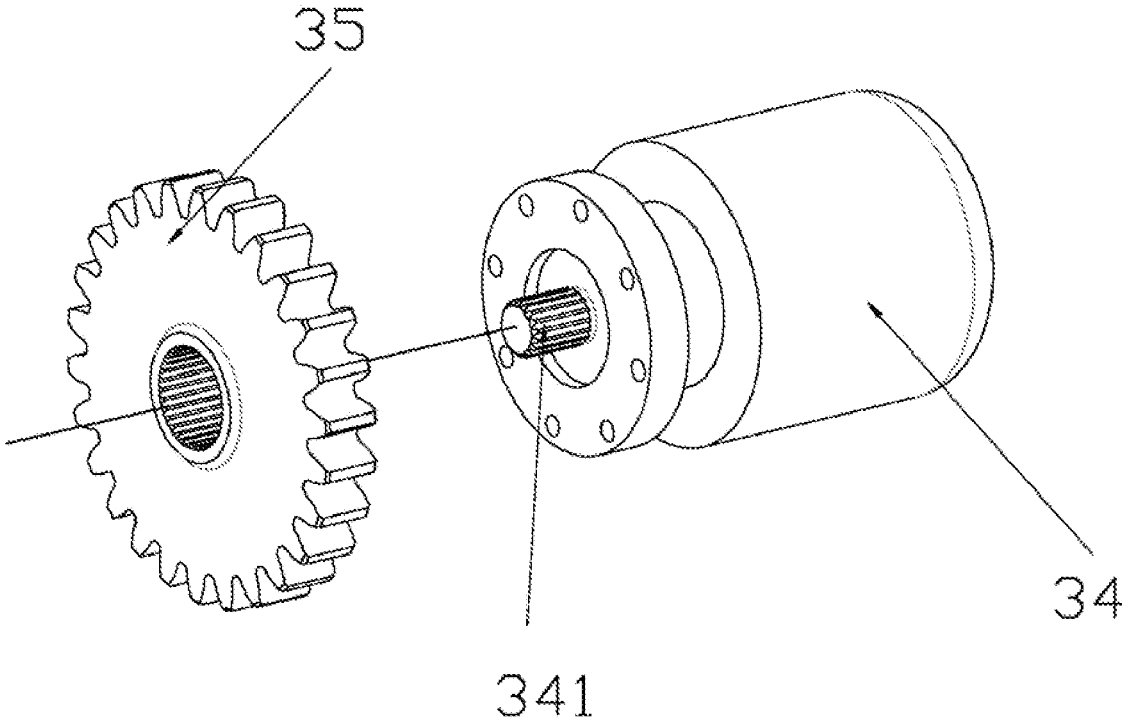
FIG. 5 is a schematic view of connection of a vibration excitation motor and a vibration excitation gear in the embodiment of the present disclosure.
Figure 6:
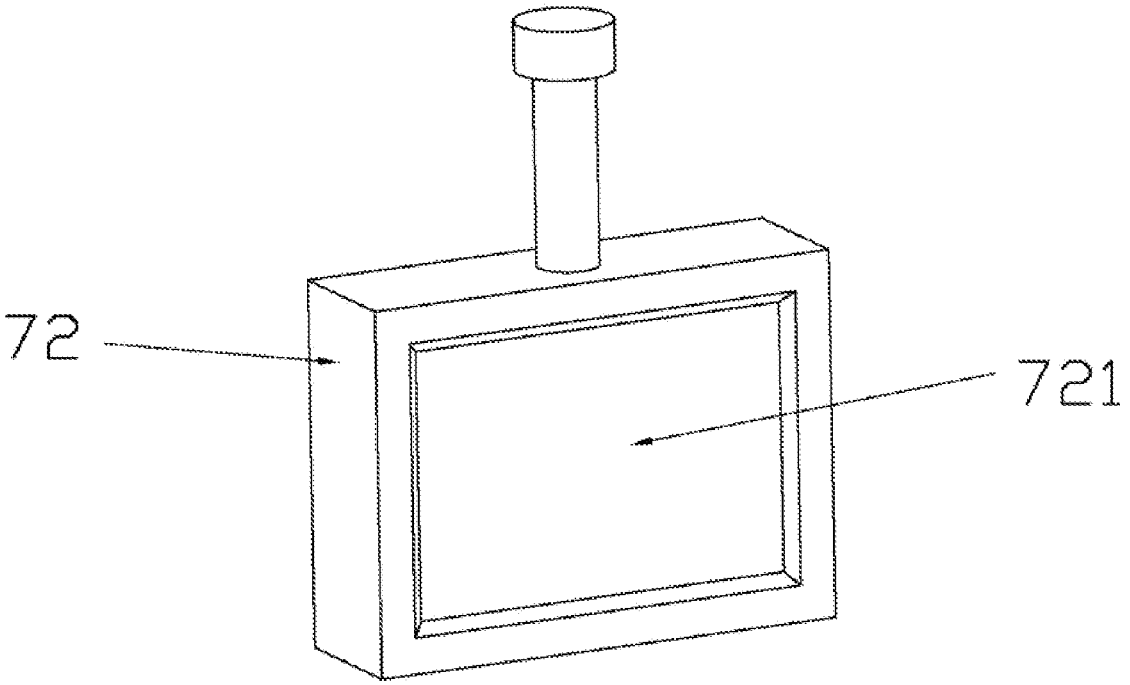
FIG. 6 is a stereoscopic schematic view of a wireless receiver in the embodiment of the present disclosure.

As shown in FIG. 1 to FIG. 6, an electrically-driven vibratory hammer comprises a vibratory hammer body 1, the vibratory hammer body 1 is sequentially provided with a vibration damping device 2, a vibration device 3 and a clamping device 4, the vibration device 3 comprises a vibration excitation box 31, a top plate 32 linked with the vibration excitation box 31, a plurality of eccentric wheels 33 and vibration excitation motors 34 linked with the eccentric wheels 33, the eccentric wheels 33 each are arranged in the vibration excitation box 31 and provided with semicircular a cross section, the vibration damping device 2 comprises a vibration damping frame 21 erected on the top plate 32, a plurality of pieces of vibration damping rubber 22 evenly distributed on the vibration damping frame 21 and a vibration absorption cover 23 connected with the vibration damping frame 21, and the clamping device 4 comprises an electrically-driven clamp 41 arranged at the end, away from the vibration damping device 2, of the vibration excitation box 31, wherein the vibratory hammer body 1 further comprises storage batteries 5, the vibration excitation motors 34 are electrically connected with the storage batteries 5, one end of the electrically-driven clamp 41 is connected with the vibration excitation box 31, the other end of the electrically-driven clamp 41 is provided with a movable toothed plate 42 and a fixed toothed plate 43, one side of the electrically-driven clamp 41 is provided with a clamping electric cylinder 44 electrically connected with the storage batteries 5, and the clamping electric cylinder 44 drives the movable toothed plate 42 to move back and forth towards the fixed toothed plate 43 through a telescopic driving structure, so that the movable toothed plate 42 and the fixed toothed plate 43 form a clamping jaw a. The telescopic driving structure comprises a motion cavity 411 for the moveable toothed plate 42 arranged inside the electrically-driven clamp 41, a piston sleeve 45 arranged in the motion cavity 411 and fixedly connected with the movable toothed plate 42, a screw rod 46 arranged in the piston sleeve 45, a driving gear 47 arranged at the output end of the clamping electric cylinder 44, and a synchronous belt 48 engaged with the driving gear 47, one end of the screw rod 46 is in threaded connection with the piston sleeve 45, a driven gear 49 meshed with the synchronous belt 48 is arranged at the other end of the screw rod 46, and the clamping electric cylinder 44 drives the piston sleeve 12 to move towards the fixed toothed plate 43 along the motion cavity 411 through the synchronous belt 49. Protective shells 6 for mounting the storage batteries 5 are arranged at a side of the vibration damping device 2, the storage batteries 5 are mounted in the protective shells 6, and mounting pressing strips 61 are arranged above the protective shells 6. A dustproof cover 412 for accommodating the synchronous belt 48 is arranged at a side of the electrically-driven clamp 41, and the driving gear 47 and the driven gear 49 are both mounted in the dustproof cover 412. The vibratory hammer body 1 further comprises wireless control devices, the wireless control devices comprise wireless receivers 71 and a remote controller 72, the wireless receivers 71 are electrically connected with the storage batteries 5, and the wireless receivers 71 are in communication connection with the vibration excitation motors 34 and the clamping electric cylinder 44. A vibration excitation gear 35 meshed with an eccentric wheel 33 is arranged at the output end of a vibration excitation motor 34, and the vibration excitation motor 34 drives the vibration excitation gear 35 to rotate through a spline shaft 341. One side of the storage batteries 5 is provided with an external cable interface 51. A perpendicularity sensor 8, a displacement sensor (not shown in the figures) and a temperature sensor 9 are mounted on the vibration excitation box 31, the perpendicularity sensor 8, the displacement sensor (not shown in the figures) and the temperature sensor 9 are all electrically connected with the storage batteries 5, and perpendicularity sensor 8, the displacement sensor (not shown in the figures) and the temperature sensor 9 are in communication connection with the wireless receivers 71. A touch control screen 721 is arranged on the remote controller 72. The vibration excitation motors 34 are arranged at two ends of the vibration excitation box 31, mounting cavities 311 for fixing the eccentric wheels 33 are formed in the vibration excitation box 31, the number of the eccentric wheels 33 is four, and the vibration excitation gears 35 and the eccentric wheels 33 are arranged in a line.

What is claimed is:

1. An electrically-driven vibratory hammer, comprising a vibratory hammer body, the vibratory hammer body being sequentially provided with a vibration damping device, a vibration device and a clamping device, the vibration device comprising a vibration excitation box, a top plate linked with the vibration excitation box, a plurality of eccentric wheels and vibration excitation motors linked with the eccentric wheels, the eccentric wheels each being arranged in the vibration excitation box and provided with a semicircular cross section, the vibration damping device comprising a vibration damping frame erected on the top plate, a plurality of pieces of vibration damping rubber evenly distributed on the vibration damping frame and a vibration absorption cover connected with the vibration damping frame, and the clamping device comprising an electrically-driven clamp arranged at an end, away from the vibration damping device, of the vibration excitation box, wherein the vibratory hammer body further comprises storage batteries, the vibration excitation motors are electrically connected with the storage batteries, one end of the electrically-driven clamp is connected with the vibration excitation box, another end of the electrically-driven clamp is provided with a movable toothed plate and a fixed toothed plate, one side of the electrically-driven clamp is provided with a clamping electric cylinder electrically connected with the storage batteries, and the clamping electric cylinder drives the movable toothed plate to move back and forth towards the fixed toothed plate through a telescopic driving structure, so that the movable toothed plate and the fixed toothed plate form a clamping jaw;

wherein the telescopic driving structure comprises a motion cavity for the movable toothed plate arranged inside the electrically-driven clamp, a piston sleeve arranged in the motion cavity and fixedly connected with the movable toothed plate, a screw rod arranged in the piston sleeve, a driving gear arranged at an output end of the clamping electric cylinder, and a synchronous belt engaged with the driving gear, one end of the screw rod is in threaded connection with the piston sleeve, a driven gear meshed with the synchronous belt is arranged at another end of the screw rod, and the clamping electric cylinder drives the piston sleeve to move towards the fixed toothed plate along the motion cavity through the synchronous belt.

2. The electrically-driven vibratory hammer according to claim 1, wherein protective shells for mounting the storage batteries are arranged at a side of the vibration damping device, the storage batteries are mounted in the protective shells, and mounting pressing strips are arranged above the protective shells.

3. The electrically-driven vibratory hammer according to claim 2, wherein the vibratory hammer body further comprises wireless control devices, the wireless control devices comprise wireless receivers and a remote controller, the wireless receivers are electrically connected with the storage batteries, and the wireless receivers are in communication connection with the vibration excitation motors and the clamping electric cylinder.

4. The electrically-driven vibratory hammer according to claim 2, wherein a vibration excitation gear meshed with an eccentric wheel is arranged at an output end of a vibration excitation motor, and the vibration excitation motor drives the vibration excitation gear to rotate through a spline shaft.

5. The electrically-driven vibratory hammer according to claim 2, wherein one side of each storage battery is provided with an external cable interface.

6. The electrically-driven vibratory hammer according to claim 1, wherein a dustproof cover for accommodating the synchronous belt is arranged at a side of the electrically-driven clamp, and the driving gear and the driven gear are both mounted in the dustproof cover.

7. The electrically-driven vibratory hammer according to claim 6, wherein the vibratory hammer body further comprises wireless control devices, the wireless control devices comprise wireless receivers and a remote controller, the wireless receivers are electrically connected with the storage batteries, and the wireless receivers are in communication connection with the vibration excitation motors and the clamping electric cylinder.

8. The electrically-driven vibratory hammer according to claim 6, wherein a vibration excitation gear meshed with an eccentric wheel is arranged at an output end of a vibration excitation motor, and the vibration excitation motor drives the vibration excitation gear to rotate through a spline shaft.

9. The electrically-driven vibratory hammer according to claim 6, wherein one side of each storage battery is provided with an external cable interface.

10. The electrically-driven vibratory hammer according to claim 1, wherein the vibratory hammer body further comprises wireless control devices, the wireless control devices comprise wireless receivers and a remote controller, the wireless receivers are electrically connected with the storage batteries, and the wireless receivers are in communication connection with the vibration excitation motors and the clamping electric cylinder.

11. The electrically-driven vibratory hammer according to claim 10, wherein a perpendicularity sensor, a displacement sensor and a temperature sensor are mounted on the vibration excitation box, the perpendicularity sensor, the displacement sensor and the temperature sensor are all electrically connected with the storage batteries, and the perpendicularity sensor, the displacement sensor and the temperature sensor are in communication connection with the wireless receivers.

12. The electrically-driven vibratory hammer according to claim 10, wherein a touch control screen is arranged on the remote controller.

13. The electrically-driven vibratory hammer according to claim 1, wherein the vibratory hammer body further comprises wireless control devices, the wireless control devices comprise wireless receivers and a remote controller, the wireless receivers are electrically connected with the storage batteries, and the wireless receivers are in communication connection with the vibration excitation motors and the clamping electric cylinder.

14. The electrically-driven vibratory hammer according to claim 13, wherein a perpendicularity sensor, a displacement sensor and a temperature sensor are mounted on the vibration excitation box, the perpendicularity sensor, the displacement sensor and the temperature sensor are all electrically connected with the storage batteries, and the perpendicularity sensor, the displacement sensor and the temperature sensor are in communication connection with the wireless receivers.

15. The electrically-driven vibratory hammer according to claim 1, wherein a vibration excitation gear meshed with an eccentric wheel is arranged at an output end of a vibration excitation motor, and the vibration excitation motor drives the vibration excitation gear to rotate through a spline shaft.

16. The electrically-driven vibratory hammer according to claim 15, wherein the vibration excitation motors are arranged at two ends of the vibration excitation box, mounting cavities for fixing the eccentric wheels are formed in the vibration excitation box, the number of the eccentric wheels is four, and the vibration excitation gears and the eccentric wheels are arranged in a line.

17. The electrically-driven vibratory hammer according to claim 1, wherein a vibration excitation gear meshed with an eccentric wheel is arranged at an output end of a vibration excitation motor, and the vibration excitation motor drives the vibration excitation gear to rotate through a spline shaft.

18. The electrically-driven vibratory hammer according to claim 1, wherein one side of each storage battery is provided with an external cable interface.

19. The electrically-driven vibratory hammer according to claim 1, wherein one side of each storage battery is provided with an external cable interface.

* * * * *